US008365814B2

(12) United States Patent
Hill et al.

(10) Patent No.: US 8,365,814 B2
(45) Date of Patent: Feb. 5, 2013

(54) PRE-VERIFICATION OF PERFORATION ALIGNMENT

(75) Inventors: Freeman L. Hill, Houston, TX (US); Tim W. Sampson, Spring, TX (US); John D. Macpherson, Sugar Land, TX (US)

(73) Assignee: Baker Hughes Incorporated, Houston, TX (US)

( * ) Notice: Subject to any disclaimer, the term of this patent is extended or adjusted under 35 U.S.C. 154(b) by 1538 days.

(21) Appl. No.: 11/858,686

(22) Filed: Sep. 20, 2007

(65) Prior Publication Data

US 2012/0193143 A1 Aug. 2, 2012

(51) Int. Cl.
*E21B 43/119* (2006.01)
*E21B 47/024* (2006.01)

(52) U.S. Cl. ..... 166/55.1; 166/255.2; 166/298; 175/4.51

(58) Field of Classification Search ..... 166/297, 166/298, 55, 55.1, 255.2; 175/4.51
See application file for complete search history.

(56) References Cited

U.S. PATENT DOCUMENTS 3,064,571 A * 11/1962 True ..... 175/4.51
3,180,409 A * 4/1965 Dewan ..... 175/4.51
3,182,724 A * 5/1965 Shore ..... 175/4.52
3,338,317 A * 8/1967 Shore ..... 175/4.51
4,410,051 A * 10/1983 Daniel et al. ..... 175/4.51
4,637,478 A * 1/1987 George ..... 175/4.51
5,107,927 A * 4/1992 Whiteley et al. ..... 166/50
5,273,121 A * 12/1993 Kitney et al. ..... 175/4.51
6,298,915 B1 * 10/2001 George ..... 166/255.2
6,378,607 B1 * 4/2002 Ryan et al. ..... 166/255.2
6,679,327 B2 * 1/2004 Sloan et al. ..... 166/297
6,837,310 B2 1/2005 Martin
6,843,318 B2 * 1/2005 Yarbro ..... 166/255.2
6,843,320 B2 * 1/2005 Yarbro ..... 166/297
7,000,699 B2 * 2/2006 Yang et al. ..... 166/255.2
7,044,236 B2 * 5/2006 Iversen et al. ..... 175/4.51
7,114,564 B2 * 10/2006 Parrott et al. ..... 166/255.2
7,383,882 B2 * 6/2008 Lerche et al. ..... 166/250.01
7,409,993 B2 * 8/2008 Han et al. ..... 166/297
7,520,323 B2 * 4/2009 Lerche et al. ..... 166/250.01
7,886,842 B2 * 2/2011 Howard et al. ..... 175/4.51
7,934,558 B2 * 5/2011 Hales et al. ..... 166/297
7,980,309 B2 * 7/2011 Crawford ..... 166/297
8,002,035 B2 * 8/2011 Hales et al. ..... 166/297
8,028,751 B2 * 10/2011 Pinto et al. ..... 166/255.2
8,061,425 B2 * 11/2011 Hales et al. ..... 166/297
8,066,083 B2 * 11/2011 Hales et al. ..... 175/4.51
2002/0088620 A1 * 7/2002 Lerche et al. ..... 166/297
2002/0185275 A1 * 12/2002 Yang et al. ..... 166/297
2003/0098158 A1 * 5/2003 George et al. ..... 166/297
2003/0102162 A1 * 6/2003 Sloan et al. ..... 175/4.51
2003/0188867 A1 * 10/2003 Parrott et al. ..... 166/297
2004/0104029 A1 * 6/2004 Martin ..... 166/298
2004/0144539 A1 * 7/2004 Smith et al. ..... 166/297
2004/0163810 A1 * 8/2004 Yarbro ..... 166/255.2

(Continued)

OTHER PUBLICATIONS

European Examination Report dated Mar. 6, 2012, for related European application.

*Primary Examiner* — Jennifer H Gay
(74) *Attorney, Agent, or Firm* — Bracewell & Giuliani LLP

(57) ABSTRACT

A perforating system, comprising a perforating gun with shaped charges, and a pre-detonation orientation apparatus and method. The pre-detonation orientation device comprises an orientation device in communication with the firing means of the perforating gun. Detonation of the shaped charges can be contingent upon the perforating gun orientation.

6 Claims, 5 Drawing Sheets

U.S. PATENT DOCUMENTS

2005/0178551 A1* 8/2005 Tolman et al. ..... 166/297
2006/0048937 A1* 3/2006 Pinto et al. ..... 166/255.2
2007/0125530 A1* 6/2007 Lerche et al. ..... 166/55.1
2008/0264639 A1* 10/2008 Parrott et al. ..... 166/297
2009/0120645 A1* 5/2009 Leising et al. ..... 166/298
2009/0200021 A1* 8/2009 Pinto et al. ..... 166/255.2
2010/0230163 A1* 9/2010 Hales et al. ..... 175/4.51
2011/0094743 A1* 4/2011 Hales et al. ..... 166/297
2011/0132607 A1* 6/2011 Lahitette et al. ..... 166/297

* cited by examiner

PRE-VERIFICATION OF PERFORATION ALIGNMENT

BACKGROUND OF THE INVENTION

1. Field of the Invention

The disclosure herein relates generally to the field of oil and gas production. More specifically, the present disclosure relates to a method and apparatus for aligning perforating charges. Yet more specifically, the present disclosure concerns a method and apparatus for confirming that a perforating charge is aligned in a certain direction prior to detonating the perforating charge.

2. Description of Related Art

Perforating systems are used for the purpose, among others, of making hydraulic communication passages, called perforations, in wellbores drilled through earth formations so that predetermined zones of the earth formations can be hydraulically connected to the wellbore. Perforations are needed because wellbores are typically completed by coaxially inserting a pipe or casing into the wellbore, and the casing is retained in the wellbore by pumping cement into the annular space between the wellbore and the casing. The cemented casing is provided in the wellbore for the specific purpose of hydraulically isolating from each other the various earth formations penetrated by the wellbore. As is known, hydrocarbon-bearing strata, such as reservoirs, exist within these formations. The wellbores typically intersect these reservoirs.

Perforating systems typically comprise one or more perforating guns strung together, these strings of guns can sometimes surpass a thousand feet of perforating length. Included with the perforating guns are shaped charges that typically include a charge case, a liner, and a quantity of high explosive inserted between the liner and the charge case. When the high explosive is detonated, the force of the detonation collapses the liner and ejects it from one end of the charge at very high velocity in a pattern called a "jet". The jet penetrates the casing, the cement and a quantity of the formation thereby forming a perforation in the formation that enables fluid communication between the wellbore and its surrounding formation.

FIG. 1 is a side partial cutaway view of a perforating system 5 comprising a perforating string 7 suspended within a wellbore 25. The perforating string 7 comprises a series of perforating guns 13 axially connected to one another. Tubing 9 is shown attached to the perforating string 7, the tubing 9 comprises a raising/lowering means and can also facilitate communication between the perforating string 7 and a surface truck 11. Using tubing for a raising/lowering means enables system deployment within all forms of deviated wellbores as well as horizontal wells. Optionally, the raising/lowering means may comprise a wireline or slickline, a tractor may be employed for wireline use within deviated or horizontal wells. The surface truck 11 typically includes a winch type device for perforating string 7 disposal and retrieval. Also included within the surface truck 11 is an interface enabling surface personnel to transmit commands and receive data to and from the perforating string 7. The communicated data between the surface and the string 7 is generally provided via the wireline 9. The perforating string 7 of FIG. 1 is shown disposed in a deviated portion of the wellbore 25. For the purposes of illustration, perforations 21 are shown that extend from the wellbore 25 into the surrounding formation 19.

The shaped charges should be aimed in a particular direction for maximum penetration of a hydrocarbon producing zone, for avoiding hardware attached to the casing, sand control or to avoid shooting into zones having either water, gas, or both. Aiming of the shaped charges can be accomplished by aligning the perforating gun 13 in a particular orientation. One manner of accomplishing perforating gun orientation is to asymmetrically load a perforating gun so that the loading will cause the gun to rotate into the desired or designed orientation. With regard now to FIG. 2, one manner of loading is shown that comprises including a weight 14 in the gun, where the weight runs along a portion of its inner housing or attached to the shape charge tube carrier. In some instances however, in spite of the asymmetric loading the guns may stick within the casing and not freely rotate into the desired orientation. With reference now to FIG. 2 again, the shaped charge 27 should be aligned with the line "L", but instead points an angular distance θ away from line "L" to produce the perforation 21.

BRIEF SUMMARY OF THE INVENTION

A perforating system comprising a perforating gun, an orientation indicator associated with the perforating gun, and a perforating gun actuator in active communication with the orientation indicator. The perforating gun actuator may be coupled to the perforating gun and may comprise a controller as well as a firing head. The controller may be configured to produce a perforating gun detonation signal in response to a signal from the orientation indicator. The signal may be an indication of a desired perforating gun orientation. A shaped charge may be included with the perforating system.

Optionally, the perforating system may comprise a perforating gun having a shaped charge, an orientation device associated with the perforating gun, and a controller in communication with the orientation device configured to provide a detonation signal to the perforating gun in response to a signal received from the orientation device, wherein the received signal is indicative of a desired orientation of the perforating gun.

Also disclosed herein is a method of perforating in a wellbore comprising, monitoring the orientation of a perforating gun, and activating the perforating gun based on the evaluated orientation. The method may include determining if the perforating gun is in a desired alignment. The method may also include activating the perforating gun upon confirmation that the perforating gun is in the desired alignment. Optionally, the perforating gun orientation may be adjusted during operation.

DETAILED DESCRIPTION OF THE INVENTION

Disclosed herein is a system and method for the perforating of a wellbore into an adjacent subterranean formation. The system and method include provisions for actively monitoring the real time orientation of a perforating gun prior to the detonation of its associated shaped charges. The method and apparatus described herein compares the real time orientation with a desired orientation. Shaped charge detonation is not initiated until the real time orientation matches the desired orientation. The system and method disclosed herein can be adjusted so that the "matching" is substantially exact or within an angular range.

Figure 1:
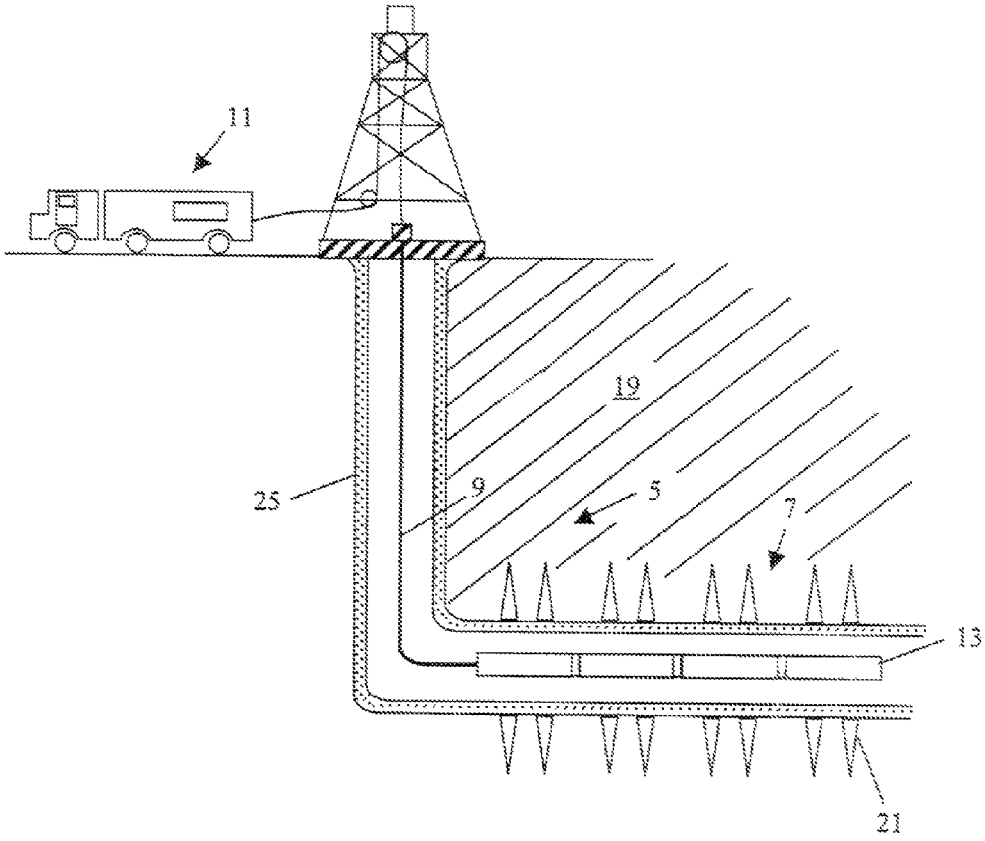
FIG. 1 (Prior Art)
FIG. 1 depicts a perforating operation in a side partial cut-away view.
Figure 2:
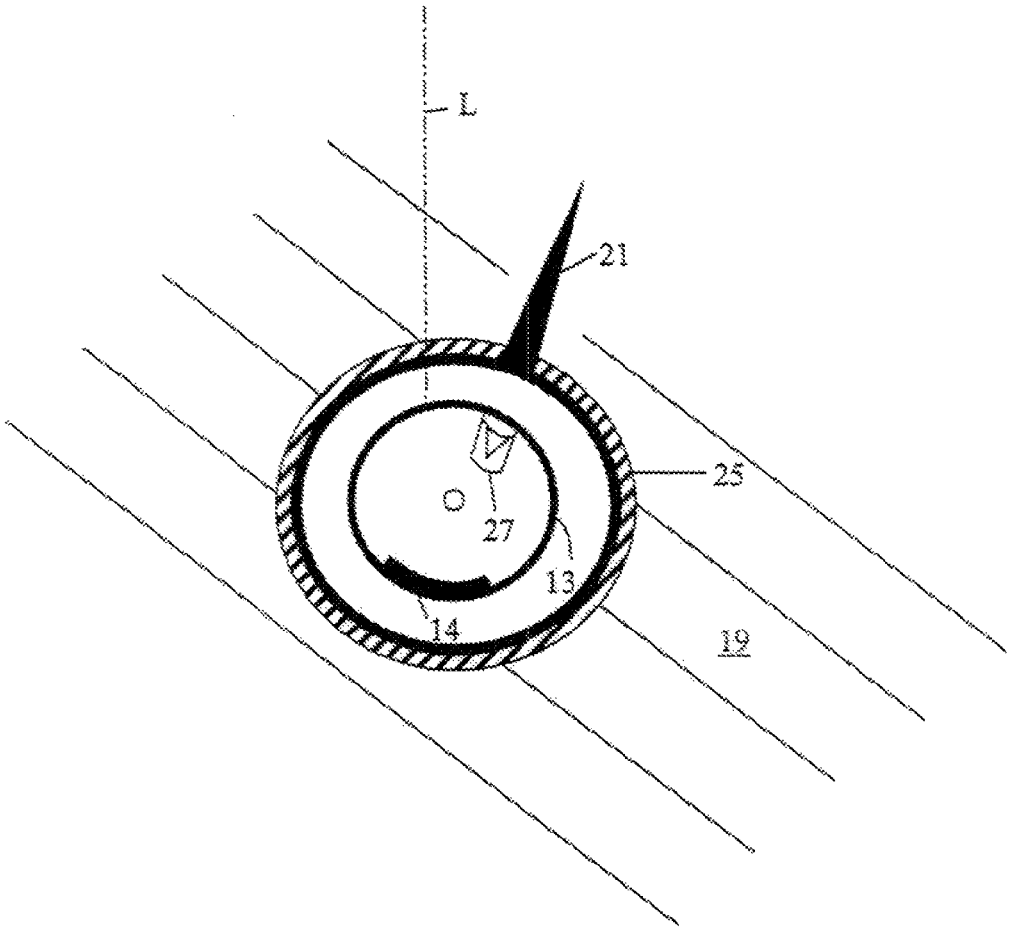
FIG. 2 (Prior Art)
FIG. 2 illustrates a shaped charge detonation in a cut-away view.
Figure 3:
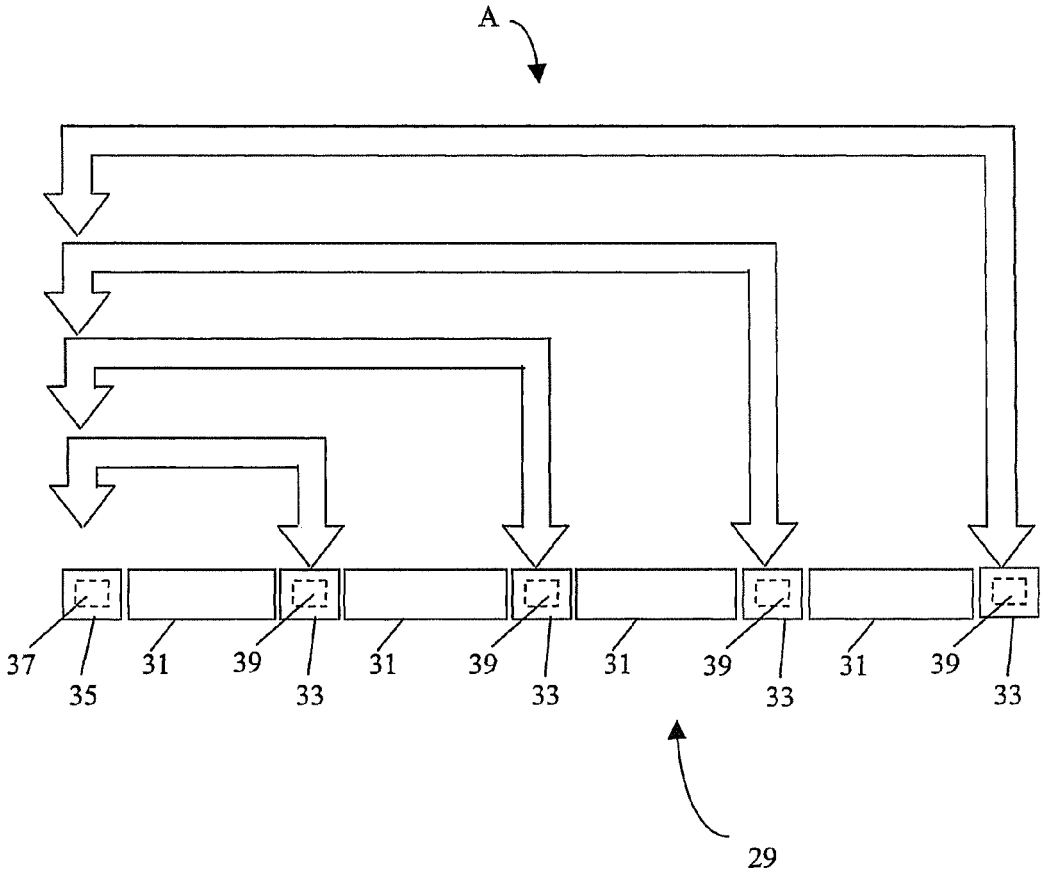
FIG. 3 portrays an embodiment of a pre-detonation verification system for perforating gun orientation.

With reference now to FIG. 3 a perforating string 29 is shown in a side view. This embodiment of the perforating string 29 comprises a series of perforating guns 31 connected at their respective ends by connector subs 33. However the scope of the present disclosure is not limited to the size and configuration of the perforating string 29 illustrated, but can include a single perforating gun, or a string comprised of a plurality of guns that far exceeds the guns in the illustrated string 29. An orientation device 39 (also referred to herein in the alternative as an orientation indicator) is shown provided with the perforating string 29. By having the orientation device 39 "with" the perforating string 29 means it can be housed within a perforating gun 31, within a connector sub 33, outside of a perforating gun 31 or sub 33, or in axial connection with the sub 33 or gun 31. In this embodiment the orientation device is shown disposed within the connector subs 33. However each perforating gun 31 or predetermined sections of a gun string should be in association with an orientation device 39. By "association" it is meant that the orientation device 39 monitors its associated perforating gun orientation. The azimuthal placement of a perforating gun within a wellbore is one example of what is meant by the term "orientation."

Also included with the perforating string 29 is a controller sub 35 disposed at one end of the perforating string 29. A controller 37 is shown in dashed outline included within the controller sub 35. As seen in the embodiment of FIG. 3 the controller 37 is in communication with each of the orientation devices 39 of this embodiment. The communication can be through individual, or combinations of, telemetry channels used for signaling. Examples are hard wire, fiber-optic, mud pressure pulse, electromagnetic field, and acoustic stress waves in steel, and any other form of communication that might transmit data from the orientation device that can be received by the controller 37. Optionally, the communication may comprise an ultra low frequency signal including combination of ultra-low frequency signals. Communications may further include ranges in frequencies ("chirps") in which the frequency is continuously varied between an initial and final frequency. Any generally known method of modulating the signal such as changing its phase (phase-shift-keying), its frequency (frequency-shift-keying), or its amplitude (amplitude-shift-keying), or combinations of these techniques, may be used to place information on the signal that is transmitted between orienting device and controller 37.

In one embodiment having more than one controller sub 35, each controller sub 35 includes a transmitter emits a signal at a select frequency when properly aligned. The signal could be a discrete frequency modulated in amplitude that identifies each individual controller sub. Misaligned subs will therefore not emit an identifying signal in the selective particular frequency. Thus if no signal is received for a particular frequency, it can be determined that the corresponding controller sub 35 (and thus the associated shaped charges) are not in the desired orientation. This knowledge provides some options of corrective action over simply knowing that one of potentially many controller subs 35 are not properly aligned.

In one example of operation of the system of FIG. 3, the perforating string 29 is inserted within a well bore and lowered to the desired depth for perforating. Once reaching the desired depth the controller 37 queries each of the orientation devices in order to obtain information regarding the orientation of each of the perforating guns 31. It should be pointed out that prior to inserting the perforating gun within the wellbore, the desired or designed orientation for each perforating gun would likely have been determined. It is well within the capabilities of those skilled in the art to determine the proper orientation of the perforating gun and configure the perforating gun so that it is able to be disposed in the proper orientation. One example of orienting a perforating gun, as discussed above, involves weighting the perforating gun in an asymmetric fashion to attain a desired or designed orientation of the perforating gun within the well bore. Once receiving the orientation data from each of the orientation devices 39, the controller 37 performs an evaluation step to ascertain if the perforating gun 31 is aligned or oriented as desired. A desired orientation of a perforating gun results in perforations that will are pointed or aimed in the desired direction. The desired orientation may include a specific azimuthal angle, either with or without some tolerances, or can include an angular, or radial orientation, range of values. Examples of angular ranges include up to 270°, up to 180°, up to 90°, up to 45°, up to 30°, and up to 15°.

The orientation evaluation may be performed for a single perforating gun, or for each perforating gun making up a perforating gun string. The controller may be configured to recognize when each perforating gun is in a desired orientation, and send a corresponding detonation signal upon recognition that one or all of the perforating guns of a perforating string are in a desired orientation. Once the controller 37 determines that each perforating gun is in its desired or designed alignment, the controller transmits a detonation signal that will in turn detonate shape charges associated with the now properly oriented perforating guns. The controller or other device for initiating perforation of the perforating string can be at surface as well as connected with a perforating string or individual perforating gun. Accordingly both the steps of activating the perforating gun by a controller as well as monitoring the orientation of the perforating gun can be performed with a controller that is disposed downhole with the perforating system or at the surface with system operator personnel.

Optionally, should the controller 37 determine that one or more of the perforating guns is not in proper or desired alignment, corrective action may be taken. The signal can be sent by the associated wireline 85 to the surface where surface operators can take corrective action. Corrective action may comprise "cycling" the perforating string within the well bore by raising and lowering the perforating string to effect the settling of the individual perforating guns into their proper alignment. After the step of cycling perforating gun orientation can again be evaluated by the controller 37 obtaining orientation data from each of the orientation devices and then re-evaluating if the guns are in their desired alignment. As discussed above, once all guns are determined to be in a proper alignment, the step of perforating can then be commenced. Should further cycling be required to adjust the guns into a desired alignment, that step can be repeated as well. Moreover, corrective action may include selectively choosing to not fire certain guns or gun segments based on if the segments are misaligned.

The orientation indicator or orientation device is associated with each of the perforating guns. That is the indicator is coupled with the perforating gun so that the indicator rotates along with any rotation of the perforating gun. Thus within the perforating gun the orientation indicator or device will necessarily rotate as it is connected to the perforating gun. However in the case when the indicator is within an associated sub, the sub must be connected to the gun such that it rotates when the gun rotates.

The controller 37 may be configured with embedded code therein that recognizes and decodes each signal received from the one or more orientation devices for determining if the perforating gun or guns in the desired orientation. Based upon the signal of proper orientation a signal is produced by the controller that in turn effectuates perforating gun detonation in response to these positive signals from the one or more orientation indicators. With regard to communication between the orientation device or orientation indicator and the controller 37, in one embodiment of the system described herein the communication is active. Active communication between these two devices comprises a real time and continuous communication between these two elements from the period of time leaving up to the perforation step. Active communication also includes conveying information (such as information pertaining to orientation) in discreet time increments as well as continuous. Thus active communication can provide information over multiple time increments and is not restricted to orientation information for a specific point in time. The controller may comprise an information handling system (IHS). The IHS may include a processor, memory accessible by the processor, nonvolatile storage area accessible by the processor, and logics for performing each of the steps above described.

FIGS. 4*a*-4*d* provide examples of different embodiments of the orientation device 39. With regard now to FIG. 4*a*, the orientation device 39*a* comprises an inner wall 41 circumscribed by an outer wall 43 thereby forming an annulus 47 between these two walls. A revolving element 45 is disposed within that annulus and allowed to freely rotate or revolve in an orbital fashion through this annulus. Due to gravitational forces, when used in conjunction with a perforating gun, the revolving element should make its way to the lower most portion of the annulus 47. Included within opposing faces of the inner and outer wall (41, 43) is a pair of opposing conductive surfaces (49, 51). The opposing surfaces are structured such that when the revolving element 45 is disposed between these two surfaces, an associated electrical circuit (not shown) closes thereby allowing current to flow from one conductive surface to the other. Accordingly, the orientation device 39*a* of FIG. 4*a* could be disposed within a perforating gun such that its desired orientation or alignment within a well bore would coincide when the revolving element 45 is residing between these conductive surfaces (49, 51).

Figure 4A:
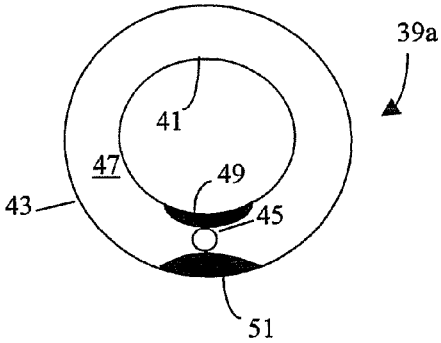
FIGS. 4*a*-4*d* are side views of embodiments of orientation indicators.

The revolving element 45 could be any member capable of rolling through the annulus 47 in response to azimuthal rotation of the orientation device 39*a*. Additionally, the revolving element 45 should also be conductive and shaped so it can close the electrical circuit when it is between the opposing conductive surfaces (49, 51). Examples of the revolving element 45 include a cylindrically shaped member, a spherical member, an oval shaped member, and disks axially connected. Moreover, the opposing conductive surfaces (49, 51) may comprise a raised portion as shown in FIG. 4*a*, but may also include extending conductive members, such as flexible contacts extending from the walls (41, 43).

Figure 4B:
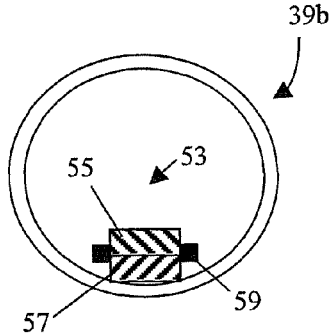

FIG. 4*b* provides another embodiment of an orientation device 39*b*. In this embodiment, a liquid interface module 53 is shown situated within an annular housing. The liquid interface module 53 comprises immiscible liquids, for example such as oil and water where one is polar and one is non-polar. In the embodiment shown, the first and second liquids (55, 57) have different polarities and thus do not mix. Additionally as shown, the first liquid 55 has a density lower than that of the second liquid 57. The surface along which these liquids (55, 57) contact forms an interface 58. Disposed on the edge of the liquid interface module is an interface detector 59. The liquid interface detector is able to detect that interface 58 between the first and the second liquid (55, 57). As with the revolving element embodiment, the liquid interface module 53 can be calibrated, such that when the perforating gun is in the desired orientation the liquid interface 58 will be aligned with the interface detector 59 on one or both sides of the liquid interface module 53. When the interface 58 is aligned with the interface detector 59 a signal may be transmitted representing proper orientation of the associated perforating gun.

Figure 4C:
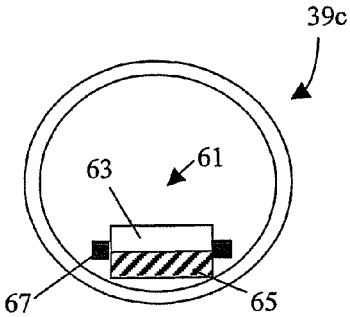

FIG. 4*c* provides another embodiment of an orientation device 39*c*. In this embodiment a switch 61 is shown comprising a housing 63. Within a portion of the housing a conductive material 65 is shown residing therein. The conductive material can be a liquid metal, or can be a particulated metal that flows within the housing based upon a gravitational pull. As shown, the conductive material 65 is in contact with lead 67 disposed on both sides of the switch 61. Therefore the switch can be designed such that when it is in a particular orientation the leads on one or both sides of the housing 63 can be in electrical communication with one another. The electrical communication can be an indication of the orientation of an associated perforating gun.

Figure 4D:
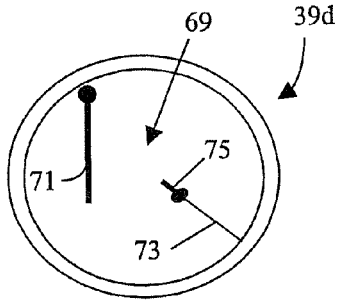

In the embodiment of FIG. 4*d*, the orientation device 39*d* comprises a switch assembly 69, wherein the switch assembly 69 comprises a pendulum element 71 and a contact 73. The pendulum element is hingely affixed within an annular housing on one end of the housing and can rotate into contact with the contact 73. The contact may optionally be provided with a flexible tip 75 that allows passage past the contact of the pendulum element 71. As with the other devices this device can be arranged with an associated perforating gun such that the pendulum element 71 is in connective and electrically communicative contact with the contact 73 thereby allowing for electrical communication between these two elements when this device is an orientation indicative or representative of a desired orientation of an associated perforating gun. Each orientation device (39*a*-39*d*) may be disposed within a perforating gun, or some other device such as a connector sub associated with the perforating gun.

Figure 5:
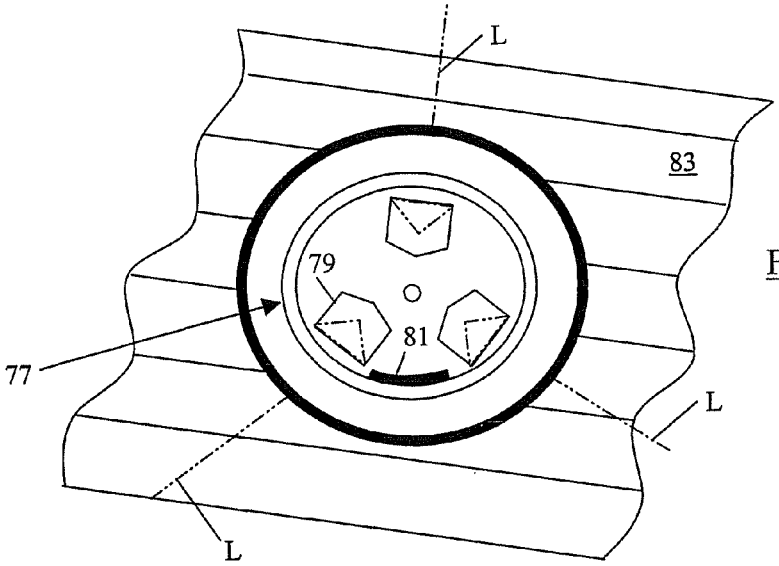
FIG. 5 is a side view of a segment of a perforating gun employing a pre-detonation orientation verification device.

Accordingly use of any of these devices with the aforementioned method can result in a situation where a perforating gun can be disposed in a well bore and orientation of the well bore can be verified prior to activation of the perforating gun. For example, with reference now to FIG. 5, a cross-sectional area of a portion of a perforating gun is shown, wherein the perforating gun comprises shaped charges 79 pointing in directions radially away from the perforating gun 77. To produce proper alignment of the shaped charges 79, a weight 81 is shown disposed along the inner housing of a portion of the perforating gun 77 (that positions the perforating gun 77 in the designed or desired orientation). As shown the weight aligns the shape charges 79 with a desired or designed orientation represented by dashed lines L.

The perforating string may include a firing head that is in active communication with the controller 37. As is known the firing head is responsible or used in initiating detonation through primer cord connected to each of the shape charge of the perforating gun. The firing head can actuate strictly electrical, strictly mechanical, or a combination of both with some redundant and isolated features.

Figure 6:
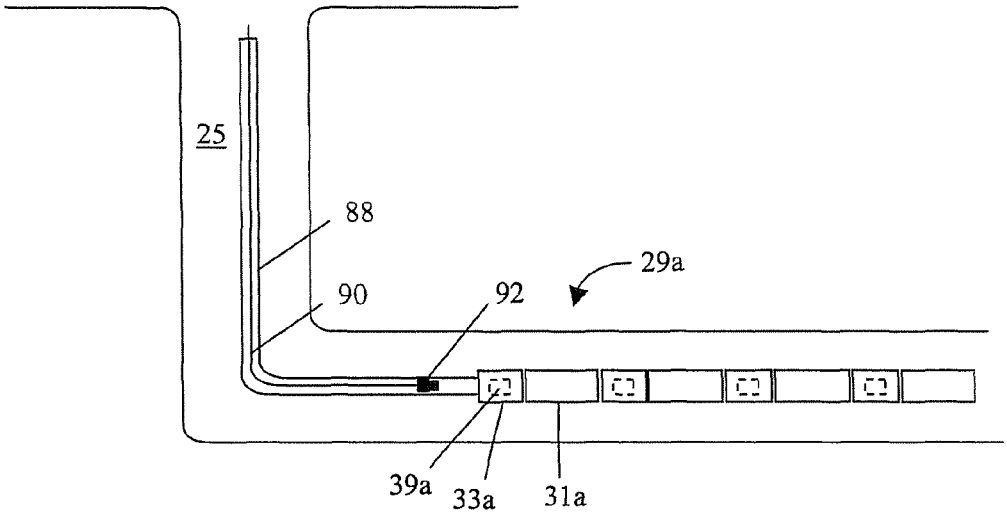
FIG. 6 shows a partial cut-away side view of an embodiment of a pre-verification system with a receiver disposed within tubing.

In FIG. 6 one alternative embodiment of the perforating string 29*a* is shown in a partial side cutaway view. In this embodiment the string 29*a* is conveyed within the wellbore 25 via tubing 88. A wireline 90 is shown coaxially inserted within tubing 88 with a receiver 92 on its terminal end. The receiver 92 can be disposed within the tubing once the pertbrating string 29*a* has been deployed within the wellbore 25. In this embodiment, the receiver 92 detects signals emitted by transmitters (not shown) regarding perforating gun orientation. For example, a signal may be transmitted from the orientation device 39*a* inside sub 33*a* and indicating orientation of the perforating gun 31*a*. Optionally the receiver 92 can be deployed in the tubing 88 and inserted into the wellbore along with the remaining portions of the system. This embodiment provides for the flexibility of removing the receiver just previous to detonation of the perforation string thereby reducing damage to the receiver 92.

Figure 7:
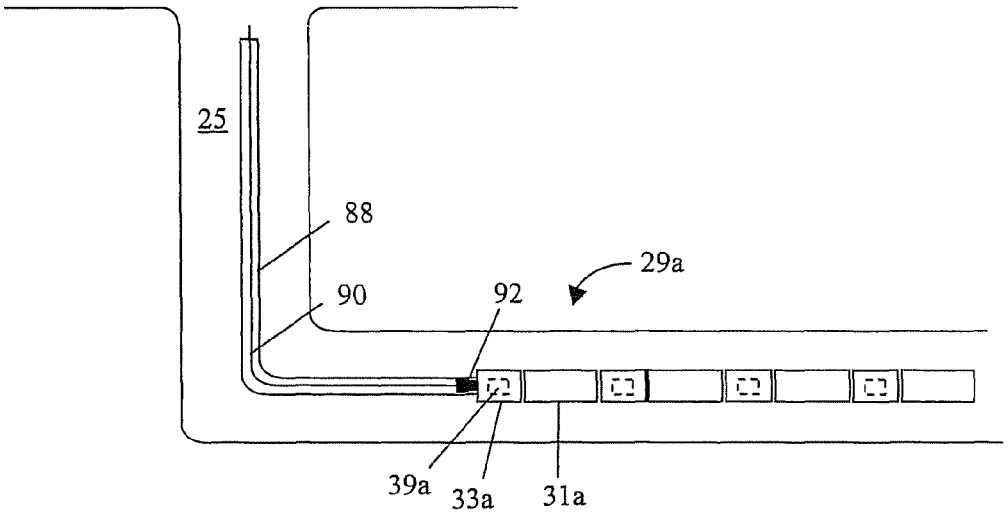
FIG. 7 is a partial cut-away side view of an embodiment of a pre-verification system having a detachable receiver.

FIG. 7 shows yet another alternative embodiment of the device described herein. In this embodiment the receiver 92 is shown releaseably attached to the uppermost portion of the perforating string 29*a*. A frangible connection (not shown) temporarily couples the receiver 92 to the perforating string. When desired the receiver 92 may be separated from the perforating string 29*a* and removed from the wellbore 25 by reeling in the wireline 90.

The present invention described herein, therefore, is well adapted to carry out the objects and attain the ends and advantages mentioned, as well as others inherent therein. While a presently preferred embodiment of the invention has been given for purposes of disclosure, numerous changes exist in the details of procedures for accomplishing the desired results. For example, the invention described herein is applicable to any shaped charge phasing as well as any density of shaped charge. The power used for operating the downhole components listed herein can be supplied by onboard batteries, or via the conveyance means. Moreover, the invention can be utilized with any size of perforating gun. It also should be pointed out that the apparatus herein disclosed is not limited to a shaped charge for use with a perforating gun, but can also include any type of ballistics shaped charge—such as those shaped charges used in weaponry and ordinance related technology as well as pressurized fluid used in perforating. These and other similar modifications will readily suggest themselves to those skilled in the art, and are intended to be encompassed within the spirit of the present invention disclosed herein and the scope of the appended claims.

What is claimed is:

1. A perforating system comprising:

a string of perforating guns, each having a shaped charge;

an orientation device associated with each perforating gun that operates in response to a gravitational force and comprises a rolling element disposed in an annular housing opposing conductive services in the housing strategically positioned so that when the rolling rolling element is between the conductive surfaces the perforating gun is in a desired orientation; and a controller in communication with each orientation device configured to provide a detonation signal to the perforating gun with which the orientation device is associated in response to a signal received from the orientation device, wherein the received signal is indicative of a desired orientation of the perforating gun.

2. The perforating system of claim 1 further comprising a monitor and a perforating gun actuator and wherein the monitor is coupled to the perforating gun actuator.

3. The perforating gun of claim 2, wherein the perforating gun actuator comprises a firing head.

4. The perforating system of claim 1, wherein the desired orientation comprises an angular range.

5. The perforating system of claim 1 further comprising an acoustic transmitter for transmitting perforating gun orientation information.

6. The perforating system of claim 1 further comprising an information handling system.

* * * * *

UNITED STATES PATENT AND TRADEMARK OFFICE

CERTIFICATE OF CORRECTION

PATENT NO. : 8,365,814 B2
APPLICATION NO. : 11/858686
DATED : February 5, 2013
INVENTOR(S) : Freeman L. Hill et al.

It is certified that error appears in the above-identified patent and that said Letters Patent is hereby corrected as shown below:

In the Claims:

Column 8, in Claim 1, line 14 the claim language "opposing conductive services" should read --opposing conductive surfaces--

Column 8, in Claim 1, line 15 the claim language "when the rolling rolling element" should read --when the rolling element--

Signed and Sealed this
Ninth Day of April, 2013

Teresa Stanek Rea
*Acting Director of the United States Patent and Trademark Office*